US005988130A

United States Patent [19]

Nakamura

[11] Patent Number: 5,988,130

[45] Date of Patent: Nov. 23, 1999

[54] ELECTRICAL SYSTEM FOR MARINE ENGINE

[75] Inventor: Kazuhiro Nakamura, Shizuoka-ken, Japan

[73] Assignee: Sanshin Kogyo Kabushiki Kaisha, Hamamatsu, Japan

[21] Appl. No.: 08/918,188

[22] Filed: Aug. 21, 1997

[51] Int. Cl.[6] ..... F02N 17/00; F02P 03/01

[52] U.S. Cl. ..... 123/179.5; 123/652; 123/623; 123/641

[58] Field of Search ..... 123/655, 652, 123/641, 640, 179.5, 406.57, 406.56, 623, 630; 320/163; 290/35, 37 R, 41

[56] References Cited

U.S. PATENT DOCUMENTS

| | | | |
|---|---|---|---|
| 4,127,782 | 11/1978 | Omura et al. | 301/10.1 |
| 4,473,025 | 9/1984 | Elliott | 114/211 |
| 4,757,249 | 7/1988 | Farber et al. | 320/126 |
| 4,917,061 | 4/1990 | Nagakura . | |
| 4,972,822 | 11/1990 | Hashizume | 123/631 |
| 5,479,909 | 1/1996 | Blakeslee et al. | 123/491 |
| 5,593,330 | 1/1997 | Kobayashi . | |
| 5,685,802 | 11/1997 | Kanno | 477/111 |

*Primary Examiner*—Willis R. Wolfe
*Assistant Examiner*—Arnold Castro
*Attorney, Agent, or Firm*—Knobbe, Martens, Olson & Bear LLP

[57] ABSTRACT

The present invention is an electrical system for an engine of the type used to power a watercraft. A primary power supply of the system is connected to a main circuit by a feed circuit. A main switch controls the flow of power from the primary power supply to the main circuit through the feed circuit. An auxiliary power supply is connected to the main circuit in a manner which allows power to flow from the auxiliary power supply to the main circuit even if the main switch is preventing power to flow from the primary power supply to the main circuit.

9 Claims, 6 Drawing Sheets

| Position of Ignition Switch (38) | | OFF | ON | START |
|---|---|---|---|---|
| Switch State | (78) Main Switch | OPEN | CLOSED | CLOSED |
| | (96) Engine Stop Switch | CLOSED | OPEN | OPEN |
| | (84) Start Switch | OPEN | OPEN | CLOSED |

ELECTRICAL SYSTEM FOR MARINE ENGINE

FIELD OF THE INVENTION

The present invention is an electrical system for a marine engine, and more particularly to an electrical system of the type having a power supply which powers various engine electrical functions such as an engine control and ignition circuit.

BACKGROUND OF THE INVENTION

Watercraft powered by inboard or outboard motors typically include an electrical system. The motor includes a water propulsion device which is powered by an internal combustion engine. As is well known, an electrical firing system is utilized to ignite the air and fuel mixture in each combustion chamber of the engine.

The electrical system for these watercraft generally includes a battery connected to an ignition circuit by a power circuit. In order to prevent the battery from being drained when the engine is not running, a main switch is provided along the ignition circuit for selectively connecting the battery to the ignition circuit.

Because of the substantial power required to run the engine, an auxiliary power source such as an engine driven generator may also be provided. Once the engine is running, this generator provides power to through a circuit leading to the battery for recharging the battery as power is drawn from the battery by the ignition circuit.

The electrical circuit may also include a starter circuit. This circuit leads from the battery to a starter motor for use in starting the engine. A switch is positioned along the circuit to selectively power the starter motor just during engine start-up.

A problem with this electrical system is that power to run the engine is always drawn through the power circuit from the battery. It sometimes happens that while the engine is running, the main switch goes bad, in which case power ceases flowing to the ignition circuit and the engine stops running. A similar problem may result if the connection between the battery and the power circuit becomes faulty. In either case, a watercraft operator may find himself far at sea with an engine which stops running.

An improved electrical system which overcomes the above-stated problems is desired.

SUMMARY OF THE INVENTION

The present invention is an electric system. Preferably, the electric system is used with a watercraft propelled by a motor which is powered by an internal combustion engine. The engine has at least one cylinder and means for providing an air and fuel mixture in the cylinder. At least one ignition element is provided corresponding to the cylinder for use in initiating the combustion of the air and fuel mixture.

The system preferably includes a primary power supply, an auxiliary power supply, and a main circuit. Preferably, an ignition circuit for firing the ignition element and an engine control unit are powered off of the main circuit. A feed circuit links the primary power supply to the main circuit. A main switch is provided for controlling the flow of power from the primary power supply to the main circuit through the feed circuit.

In accordance with the present invention, a firing circuit leads from the auxiliary power unit to the main circuit for providing power thereto independent of the primary power supply. Preferably, the auxiliary power unit is an engine powered generator, and the primary power supply comprises a battery. A charging circuit may lead from the generator to the battery for charging of the battery.

Advantageously, even if the main switch breaks and the flow of power from the battery to the main circuit stops, the generator will still provide power to the ignition circuit and control unit, at least under certain conditions, allowing the engine to remain running.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention relates to an electrical system for a watercraft powered by an internal combustion engine. The electrical system is arranged so that an auxiliary power supply provides power to the engine while the engine is running even if power ceases flowing from a primary power source to a main circuit, such as might occur if a main switch controlling the flow of power between the primary power source and main circuit causes a break in the circuit therebetween.

Figure 1:
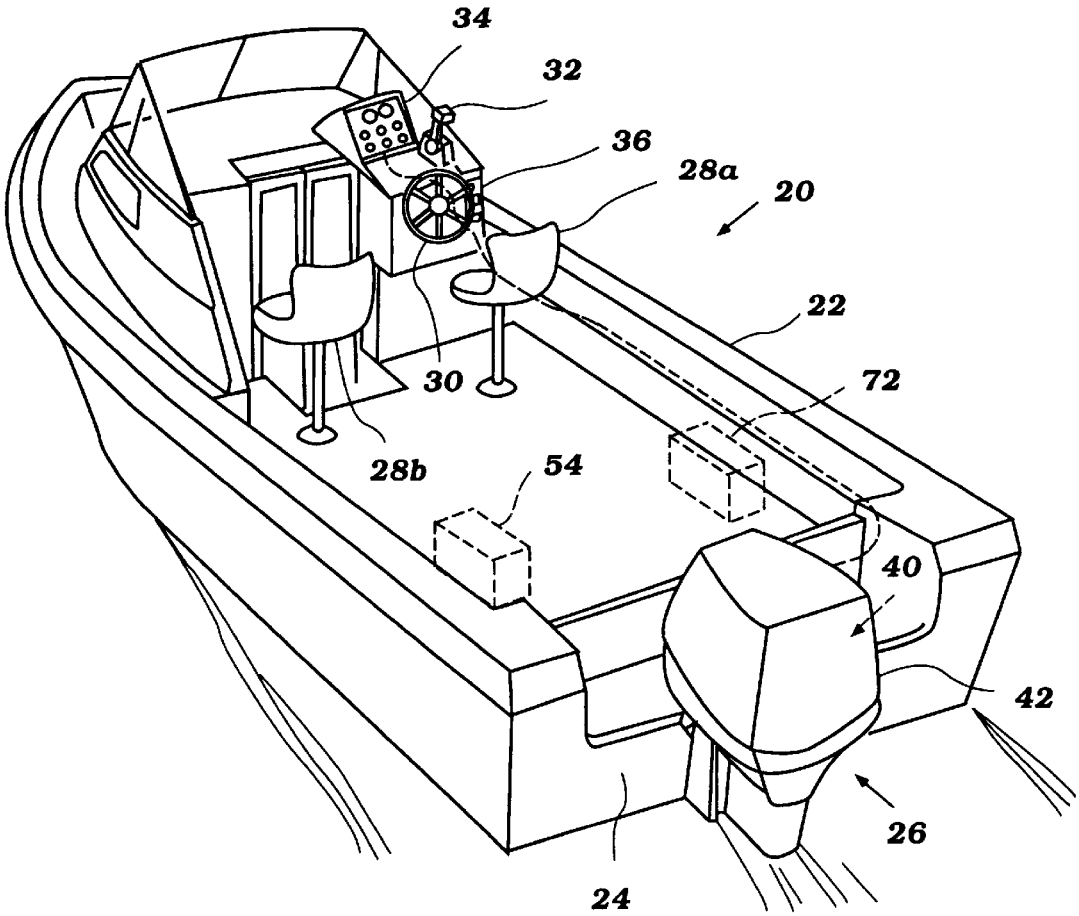
FIG. 1 is a perspective view of a watercraft propelled by an outboard motor.

Referring to FIG. 1, there is illustrated a watercraft 20. The watercraft 20 illustrated is a power boat, but it is contemplated that the present invention may be utilized with other types of crafts. The watercraft 20 has a hull 22 with a transom portion 24 to which is mounted an outboard motor 26. The outboard motor 26 is utilized to propel the watercraft 20. As known to those skilled in the art, the motor 26 may also be of the inboard type.

When of the outboard variety, the motor 26 is connected to the watercraft 20 in a manner which allows it to pivot up and down in a vertical plane ("trimming") and rotate left and right in a horizontal plane ("steering") in a manner well known to those skilled in the art.

The watercraft 20 illustrated includes a pair of seats 28*a,b*, each seat for supporting a user of the craft. One of the seats 28*a* is preferably positioned near a steering wheel 30. The steering wheel 30 is connected remotely to the outboard motor 26 for effectuating movement of the motor left and right for steering the craft. Additionally, a throttle control such as a handle 32 is preferably positioned near the steering wheel 30 for use in controlling the speed of the watercraft 20 by changing the speed of the engine powering the motor 26.

A control panel 34 is preferably provided near the steering wheel 30, the control panel 34 having one or more gauges, meters or other displays for displaying various information to the user of the watercraft 20. These displays may display watercraft speed and the like. A switch panel 36 is also provided near the steering wheel 30. The switch panel 36 preferably includes one or more switches or controls, such as an ignition switch 38 (see FIG. 2), one or more light switches and the like.

Figure 2:
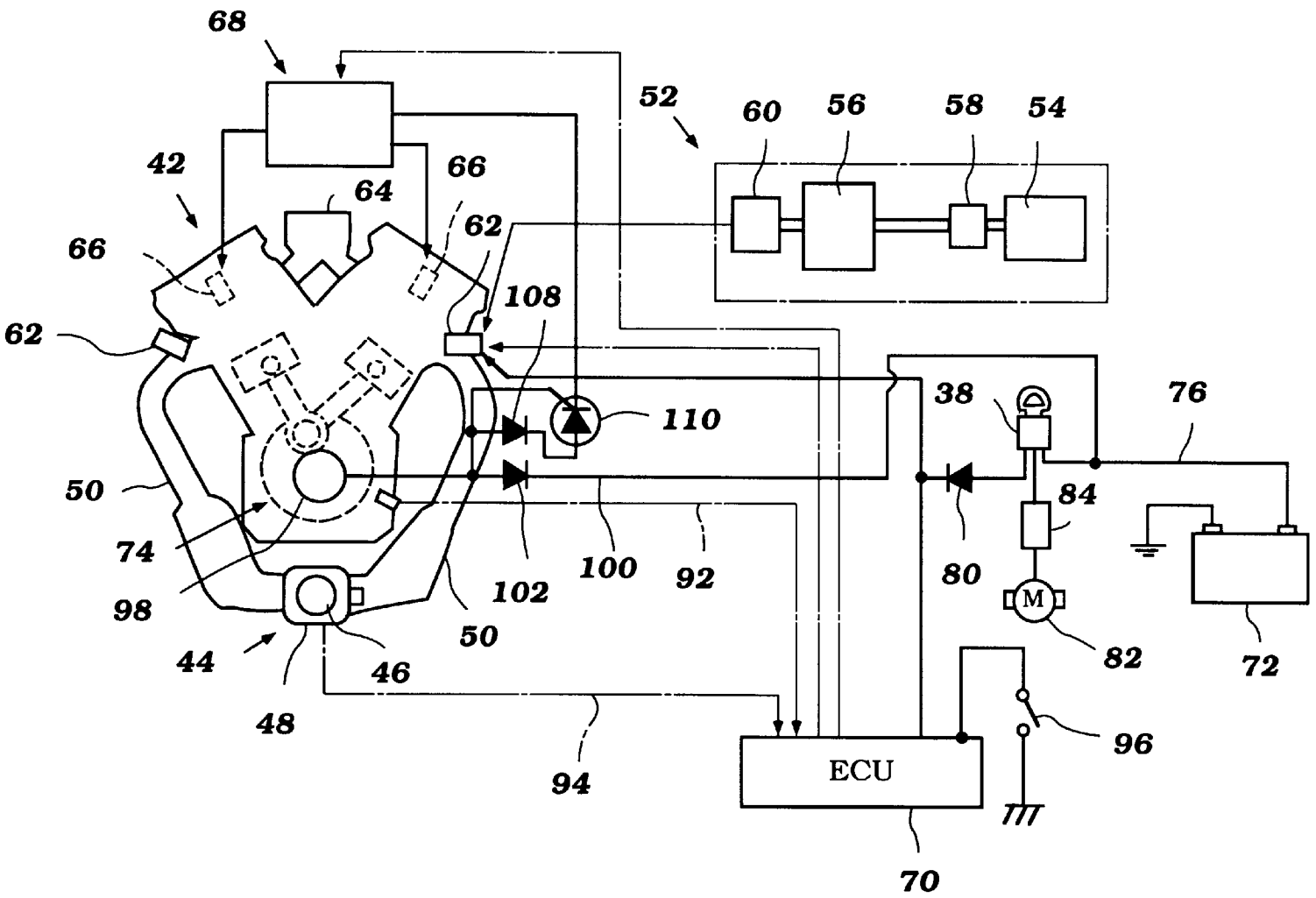
FIG. 2 is a diagram illustrating the interrelationship of an engine of the motor and an electrical system in accordance with the present invention.

Referring now to FIGS. 1 and 2, the motor 26 has a water propulsion device, such as a propeller (not shown) which is powered by an engine 40. The engine 40 is preferably mounted within a cowling 42 of the motor 26. In the embodiment illustrated, the engine 40 has 6 cylinders arranged in a "V" format, and operates on a four-cycle principal. So arranged, the engine 40 has first and second banks of three cylinders each, the banks separated by a valley. Each cylinder has a piston (not shown) movably positioned therein and attached to a crankshaft. The engine 40 is oriented within the cowling 42 so that the crankshaft is generally vertically extending and in driving relation with the water propulsion apparatus of the motor 26.

It should be understood that the engine 40 may be of a variety of types and arrangements, including as few as one cylinder or more than 6, being arranged in in-line, flat or other configurations. The engine may also operate on a two-cycle principal or be of the rotary type.

As is well known to those skilled in the art, an intake system 44 provides air to each cylinder of the engine 40. The intake system 44 includes an inlet 46 having a throttle valve 48 positioned therein. The valve 48 may be of the butterfly or other type. Air passing past the valve 48 is routed through one or more passages in an intake manifold 50 leading to the cylinders of each bank of the engine 40.

A fuel supply system 52 is provides fuel to each cylinder for combustion therein with the air. The fuel supply system 52 preferably includes a fuel tank 54 positioned within the hull 22 of the watercraft 20.

Fuel within the tank 54 is pumped to a vapor separator 56 by a low pressure fuel pump 58. This pump 58 may be positioned near the fuel tank 54 in the watercraft 20, or within the cowling 42 near the engine 40. The vapor separator 56 is preferably positioned near the engine 40. The vapor separator 56 is of a type known in the art adapted to separate air and other gases from the liquid fuel.

A high pressure pump 60 pumps fuel from the vapor separator 56 and delivers it under high pressure to one or more fuel injectors 62 for delivering fuel to the air supplied to each cylinder. In the embodiment illustrated, a fuel injector 62 is provided corresponding to each cylinder and arranged to inject the fuel directly into each cylinder.

As is well known, other charge formers may be used for providing the fuel to the air. In addition, when fuel injectors are used, they may be arranged to deliver the fuel indirectly to the cylinders.

A spark plug 66 or other ignition element is provided corresponding to each cylinder for igniting the fuel and air mixture supplied to each cylinder. Each spark plug 66 is charged in a manner described in greater detail below.

Exhaust generated by the combustion of the fuel and air mixture in each cylinder is routed through an exhaust port into an exhaust system 64. The exhaust system 64 routes the exhaust from the engine 40 to a point external to the motor 26.

Figure 3:
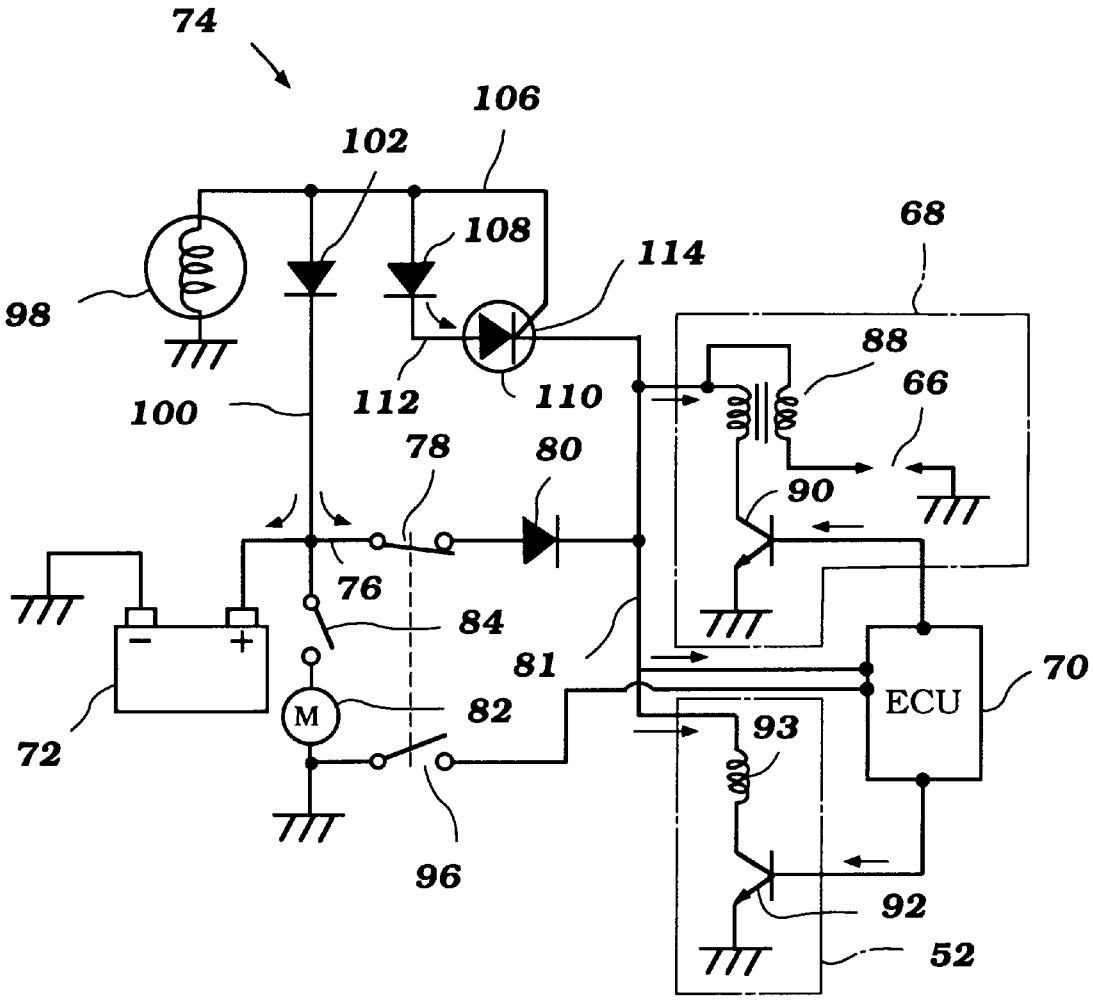
FIG. 3 is a detailed circuit diagram of the electrical system illustrated in FIG. 2.

The motor 26 includes an electrical system in accordance with the present invention. A first embodiment of this system is illustrated in FIGS. 2 and 3. In general, this system includes a main circuit 81 including or powering one or more engine or watercraft electrical features, such as an ignition system or circuit 68, an electronic engine control (ECU) 70, and one or more components of the fuel supply system 52. In addition, the system includes a primary power source or supply 72 and an auxiliary power source or supply 74 for providing power to the main circuit 81.

The primary power supply 72 preferably comprises a battery. As illustrated in FIG. 1, the battery may be conveniently mounted in the watercraft 26. The ECU 70 and the ignition system 68 are arranged to be powered, during at least certain times, by the battery 72.

As illustrated in FIG. 3, a feed circuit 76 is utilized to provide power from the battery 72 to a main circuit 81. Preferably, a main switch 78 is provided along the feed circuit 76 for use in selectively allowing power to flow from the battery 72 to the main circuit 81. In addition, a diode 80 is provided along this circuit 76 for allowing only the one-way flow or power from the battery 72 in the direction of the main circuit 81.

Figure 4:
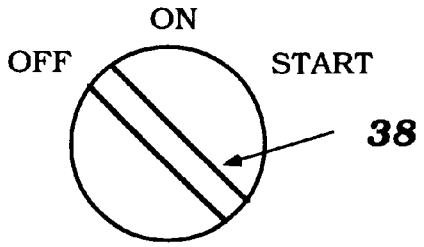
FIG. 4 is a table illustrating the positions of various switches of the electrical system illustrated in FIG. 3 as relating to the position of an ignition switch of the system.

The main switch 78 is preferably a part of the ignition switch 38. As illustrated in FIG. 4, the ignition switch 38 may be of the three-position type, having "ON" "OFF" and "START" positions. As is known in the art, however, the switch 78 may be of other varieties, including the non-movable digital type.

A starter motor 82 is selectively powered off by the battery 72 as controlled by a starter switch 84. The starter motor 82 is arranged to engage a toothed flywheel or the like for effectuating rotation of the crankshaft of the engine 40 for starting the engine as is well known. Preferably, the starter switch 84 is actuated by the ignition switch 38, such as when the switch 38 is moved to the "START" position (see FIG. 4).

The ignition system 68 includes a charging coil 88, the spark plugs 66, and means for controlling the charging of the charging coil 88. Power is supplied to the charging coil 88 from the main circuit 81. The means for controlling the coil 88 preferably comprises the ECU 70 and a transistor 90 which is selectively turned on and off by the ECU 70.

The ECU 70 is provided with spark plug firing timing data, such as from a crankshaft angle sensor 92. The ECU 92 utilizes this and/or other data for determining when to turn on and off the transistor 90. The turning on and off of the transistor 90, which is linked through a circuit to the coil 88, selectively permits charging of the coil 88. Upon discharge of the coil 88, a spark is provided at the spark plug 66 for ignition the air and fuel mixture in a charged cylinder.

The fuel supply system 52 is powered by the electric circuit and controlled, at least in part, by the ECU 70. As illustrated in FIG. 3, the solenoid 93 operating each fuel injector 62 is powered off of the main circuit 81. The solenoid 93 is selectively powered by the ECU 70 with a transistor 92 in a manner similar to that described above. Preferably, throttle valve opening angle data is provided to the ECU 70 by a sensor 94. The ECU 70 utilizes this information to determine the amount of fuel the engine requires and the like.

An engine stop or kill switch 96 is provided between the ECU 70 and ground, as best illustrated in FIG. 2. The kill switch 96 is preferably operated in conjunction with the ignition switch 38 in a manner described in more detail below.

The ECU 70 is preferably of any suitable type as known to those skilled in the art, and may have additional functions to those described above and may obtain data from a variety of other sensors.

The auxiliary power system 74 preferably includes a generator 98 of the type which is incorporated into the flywheel or similar element connected to the crankshaft of the engine 40, whereby rotation of the crankshaft generates electricity.

A charging circuit 100 is provided from the generator 98 to the battery 72, such that when the engine 40 is running and the generator 98 is generating sufficient power, the battery 72 is charged. A rectifying diode 102 is provided along the circuit 100 for both rectifying the current provided by the generator to the battery 72, and for allowing power to flow only in the direction of the generator 98 to the battery 72.

The auxiliary power supply 68 also includes a firing circuit 106 through which power from the generator 98 is selectively supplied to the main circuit 81. The firing circuit 106 includes a diode 108 and a gated thyristor 110. The diode 108 is positioned along a first branch 112 of the firing circuit 106, with the thyristor 110 positioned along the same branch downstream of the diode 108. The diode 108 permits the flow of power only in the direction of the thyristor 110 along the first branch 112.

A second branch 114 of the firing circuit 106 by-passes the diode 108 and extends to the gate portion of the thyristor 110 for use in selectively turning on and off the thyristor 110. The firing circuit 106 then leads from the thyristor output to the main circuit 81. So arranged, and as described in more detail below, the gated thyristor 110 serves to prevent the flow of power from the generator 98 to the main circuit 81 unless sufficient power is being generated by the generator 98.

FIG. 4 illustrates the relative positions of the main, kill and starter motor switches 78,96,84 based on the position of the main ignition switch 38. This figure will be used in conjunction with FIGS. 2 and 3 to describe circuit activity at each switch position.

As illustrated therein, when the ignition switch 38 is moved to the "START" position, the main switch 78 is closed, the engine kill or stop switch 96 is opened, and the starter motor switch 84 is closed. With the switches in these positions, power flows from the battery 72 to the starter motor 82, cranking the engine 40. At the same time, power flows through the main switch 78 to the main circuit 81, and thus the fuel system components 52, the ECU 70 and the ignition system 68 for effectuating a firing of the spark plugs 66 and delivery of fuel to the engine 40.

After the engine 40 has started, the ignition switch 38 moves to its "ON" position. As one example, the ignition switch 38 may be of the type which when turned to the "START" position and then released automatically returns to the "ON" position. When the ignition switch 38 is in the "ON" position, the main switch 78 is closed and the stop switch 96 open, while the starter switch 84 opens, thus shutting off the starter.

When the ignition switch 38 is in this position and the engine 40 is running, the generator 98 generates electric current. A portion of this current flows through the charging circuit 100 to the battery 72. Other current flows through the firing circuit 106. In the event the voltage produced is large enough (through branch 114) the gate of the thyristor 110 is opened and power flows past the thyristor 110 to the main circuit 81. When the engine 40 is running at a low rpm, the current generated by the generator 98 may be low, and thus the engine 40 is powered by the battery 72, with partial recharging of the battery possibly occurring with the charge generated by the generator 98.

On the other hand, when the engine 40 is operating at a high enough speed, the generator 98 generates sufficient power to power the ECU 70, ignition system 68 and fuel supply components, and possibly also charge the battery 72.

When the ignition switch 38 is moved to the "OFF" position, the main switch 78 opens, the starter switch 84 remains open, and the kill switch 96 closes. At this time, the starter motor 82 remains shut off, and power is prevented from flowing from the battery 72 to the remainder of the circuit by the open main switch 78. At the same time, the engine is shut off as the kill switch 96 closes, grounding the circuit including the generator 98.

Advantageously, in accordance with the present invention in the event the main switch 78 breaks or the connection between the battery 72 and the main circuit 81 is otherwise broken when the ignition switch 38 is in the "ON" position, power will still be provided to main circuit 81, allowing the engine to continue running. For example, while the engine 40 is running and the main switch 78 breaks and opens, the auxiliary power unit 74 will continue to generate power which flows through the firing circuit 106 to the main circuit 81, thus powering the ignition circuit 68, ECU 70, and fuel system components 52, allowing the engine to continue running. The auxiliary power unit 74 will continue to provide power as long as the engine runs at sufficient speed for the generator 98 to generate power at a level which opens the gate 114.

Figure 5:
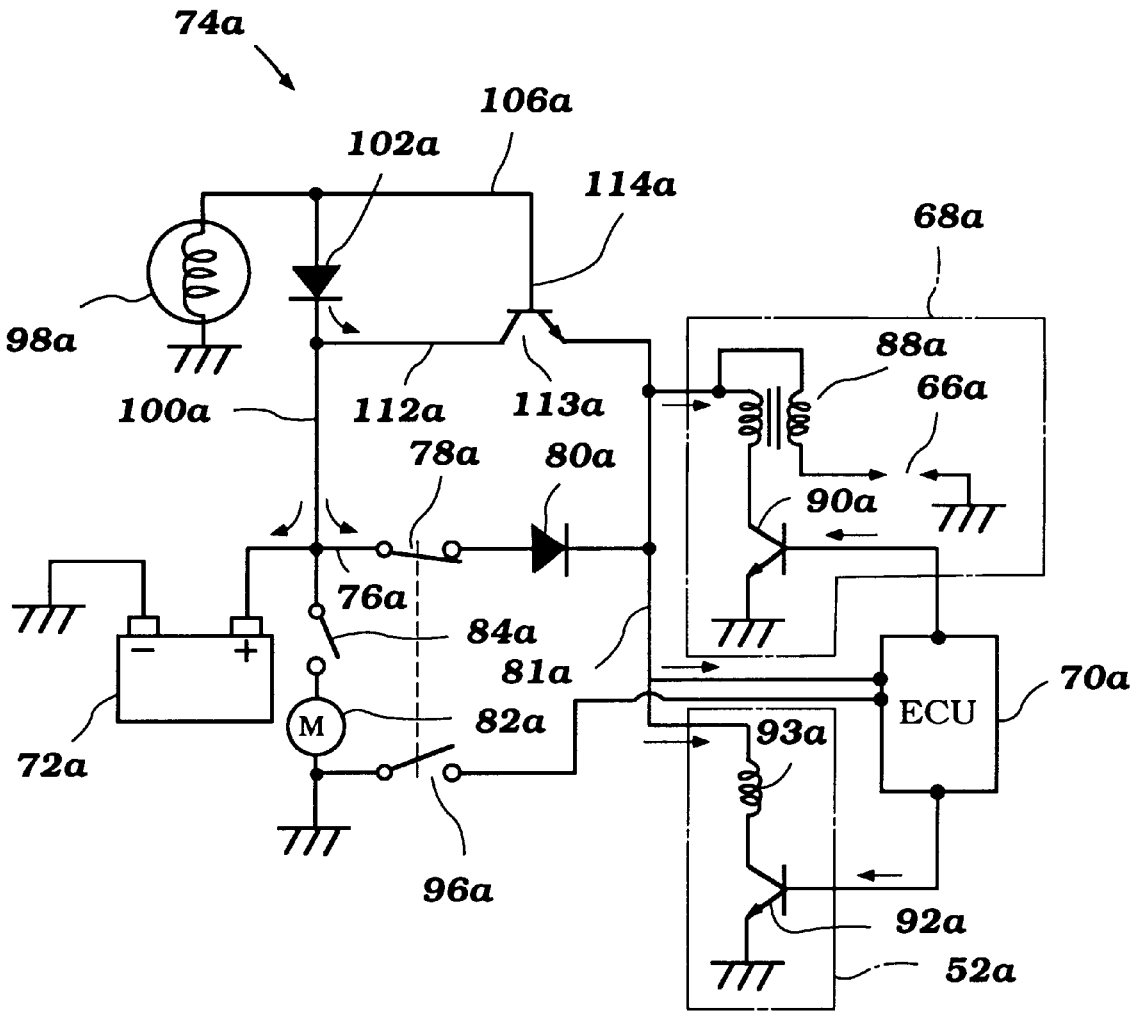
FIG. 5 is a circuit diagram of an electrical system for an engine powering a motor propelling a watercraft as illustrated in FIG. 1 in accordance with a second embodiment of the present invention.

An electrical system in accordance with a second embodiment of the present invention is illustrated in FIG. 5. In this embodiment, like parts have been given like reference numerals to those used in the embodiment illustrated in FIGS. 2 and 3 and described above, except that an "a" designator has been added thereto.

This embodiment is similar to the last, in that the system includes a primary power supply in the form of a battery 72*a* connected through a feed circuit 76*a* to a main circuit 81*a* as controlled by a main switch 78*a*, and an auxiliary power supply in the form of a generator 98*a* connected to the main circuit 81*a* through a firing circuit 106*a*. A power circuit 100*a* also links the generator 98*a* to the battery 72*a*.

In this embodiment, however, a first branch 112*a* of the firing circuit 106*a* leads from the charging circuit 100*a* downstream of the rectifying diode 102*a* to a transistor 113*a*. The second branch 114*a* of the firing circuit 106*a* also leads to the transistor 113*a*. So arranged, when the power generated by the generator 98*a* is sufficiently large, the transistor 113*a*, which serves as a gate, allows power to flow therethrough to the ignition circuit 68*a* and ECU 70*a* in a manner similar to that illustrated above.

This system has the same advantages of the system described above, and in addition is somewhat simpler, eliminating one diode (108 in FIG. 3).

Figure 6:
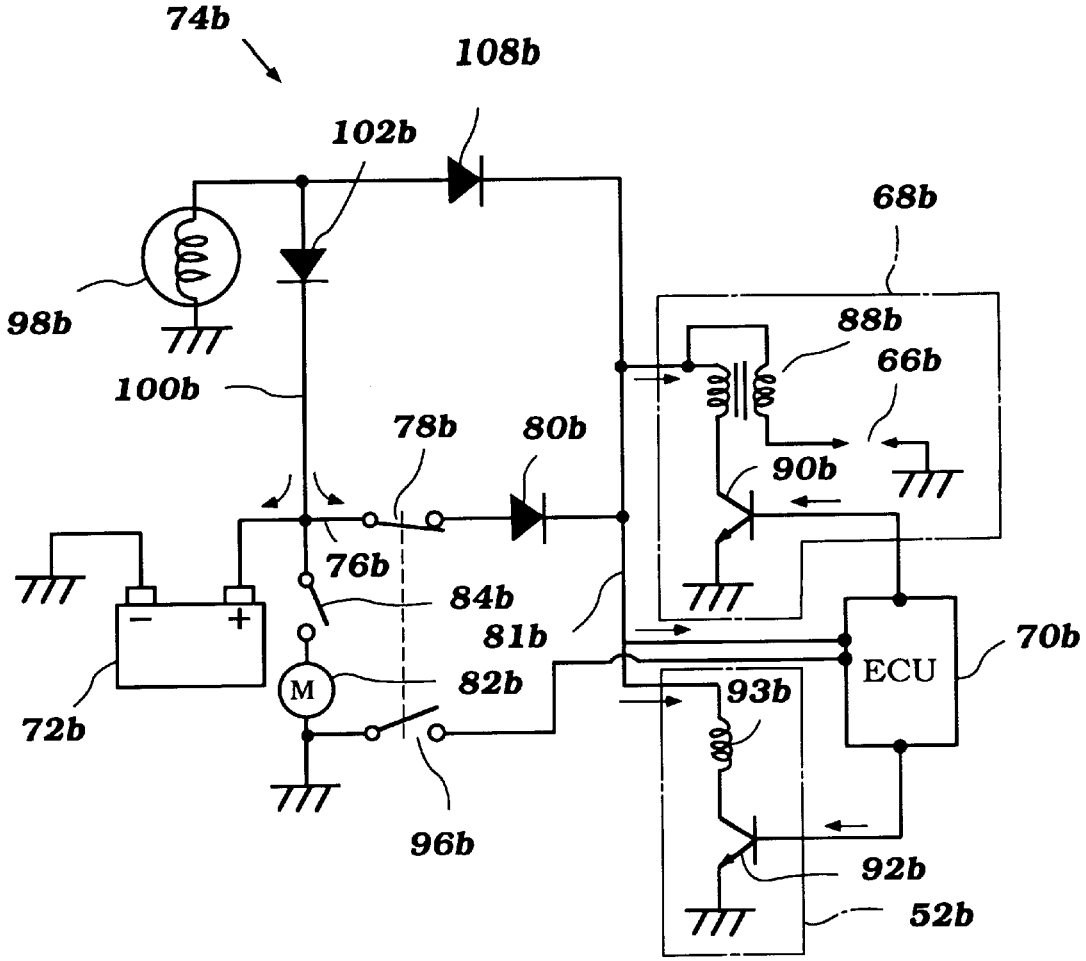
FIG. 6 is a circuit diagram of an electrical system for an engine powering a motor propelling a watercraft as illustrated in FIG. 1 in accordance with a third embodiment of the present invention.

An electrical system in accordance with a third embodiment of the present invention is illustrated in FIG. 6. In this embodiment, like parts have been given like reference numerals to those used in the embodiments illustrated and described above, except that a "b" designator has been added thereto.

This embodiment is similar to others, in that the system includes a battery 72*b* connected to a main circuit 78*b* through a feed circuit 76*a* controlled by a main switch 78*a*. A generator 98*b* is connected to the main circuit 81*b* through a firing circuit 106*b*. In this embodiment, the firing circuit 106*b* has but a single branch leading to a rectifying diode 108*b* and thereon to the main circuit 81*b* and thus ignition circuit 68*b*, ECU 70*b* and fuel system components 52*b*. Thus, in this system, and as compared to the first two embodiments, power is provided to the ignition circuit 68*b* and ECU 70*b* regardless of the power output by the generator 98*b*. The diode 108*b* is used to prevent the flow of power in the direction of the generator 98*b* from the remainder of the system.

Of course, the foregoing description is that of preferred embodiments of the invention, and various changes and modifications may be made without departing from the spirit and scope of the invention, as defined by the appended claims.

What is claimed is:

1. An electrical system for an engine of a watercraft, said engine having at least one combustion chamber and an ignition element for initiating combustion of an air and fuel mixture within said chamber, said system including a battery, an engine powered generator, and an ignition circuit for firing said ignition element, a feed circuit leading from said battery to said ignition circuit and control unit, and a main switch for selectively permitting power to flow from said battery through said feed circuit to said ignition circuit and control unit, said engine powered generator including a firing circuit leading to said ignition circuit for providing power thereto independent of said battery and said main switch.

2. The electrical system in accordance with claim 1, wherein said main switch is operated by an ignition switch.

3. The electrical system in accordance with claim 2, further including a kill switch and a starter motor switch, said switches also operated by said ignition switch.

4. The electrical system in accordance with claim 1, wherein means are provided along said firing circuit for controlling the flow of power from said engine powered generator to said ignition circuit.

5. An electrical system for an engine of a watercraft, said engine having at least one combustion chamber and an ignition element for initiating combustion of an air and fuel mixture within said chamber, said system including a primary power supply, an auxiliary power supply, and an ignition circuit for firing said ignition element, a feed circuit leading from said primary power supply to said ignition circuit and control unit, a main switch for selectively permitting power to flow from said primary power supply through said feed circuit to said ignition circuit and control unit, said auxiliary power supply including a firing circuit leading to said ignition circuit for providing power thereto independent of said primary power supply, and means provided along said firing circuit for controlling the flow of power from said auxiliary power supply to said ignition circuit comprising a thyristor.

6. An electrical system for an engine of a watercraft, said engine having at least one combustion chamber and an ignition element for initiating combustion of an air and fuel mixture within said chamber, said system including a primary power supply, an auxiliary power supply, and an ignition circuit for firing said ignition element, a feed circuit leading from said primary power supply to said ignition circuit and control unit, a main switch for selectively permitting power to flow from said primary power supply through said feed circuit to said ignition circuit and control unit, said auxiliary power supply including a firing circuit leading to said ignition circuit for providing power thereto independent of said primary power supply, and means provided along said firing circuit for controlling the flow of power from said auxiliary power supply to said ignition circuit comprising a transistor.

7. The electrical system in accordance with claim 1, further including a control unit, said feed circuit leading to said control unit and said firing circuit leading to said control unit.

8. The electrical system in accordance with claim 1, wherein a charging circuit connects said engine powered generator with said battery, whereby said engine powered generator may be used to charge said battery.

9. The electrical system in accordance with claim 1, wherein a diode is positioned along said feed circuit for allowing the flow of power from said battery through said feed circuit in the direction of said ignition circuit.

* * * * *